US010283286B2

(12) United States Patent
Kroepfl

(10) Patent No.: US 10,283,286 B2
(45) Date of Patent: May 7, 2019

(54) SWITCH ELEMENT WITH AN OPENING FOR USE IN A POTENTIALLY EXPLOSIVE AREA

(71) Applicant: Tyco Electronics Austria GmbH, Vienna (AT)

(72) Inventor: Christian Kroepfl, Waidhofen (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 15/348,418

(22) Filed: Nov. 10, 2016

(65) Prior Publication Data

US 2017/0062147 A1 Mar. 2, 2017

Related U.S. Application Data

(63) Continuation of application No. PCT/EP2015/059688, filed on May 4, 2015.

(30) Foreign Application Priority Data

May 12, 2014 (DE) ..... 10 2014 006 957

(51) Int. Cl.
*H01H 9/04* (2006.01)
*H01H 50/02* (2006.01)

(52) U.S. Cl.
CPC ..... *H01H 9/042* (2013.01); *H01H 9/043* (2013.01); *H01H 9/047* (2013.01); *H01H 50/023* (2013.01); *H01H 2223/002* (2013.01)

(58) Field of Classification Search
CPC ..... H01H 9/042; H01H 9/043; H01H 9/047; H01H 50/023; H01H 2223/002; H01H 2009/02; H01H 2213/00; H01H 2215/048; H01H 2223/00; H01H 2223/006; H01H 2223/044; H01H 9/02; H01H 9/0264; H01H 9/04; H01H 9/041
(Continued)

(56) References Cited

U.S. PATENT DOCUMENTS 4,177,367 A * 12/1979 Tirone ..... H01H 13/36 200/535
4,260,863 A * 4/1981 Appleton ..... H01H 9/043 218/1
(Continued)

FOREIGN PATENT DOCUMENTS

CN 101794680 A 8/2010
DE 2902169 A1 7/1980
(Continued)

OTHER PUBLICATIONS

German Office Action, dated Oct. 2, 2014, 12 pages.
(Continued)

*Primary Examiner* — Anthony R Jimenez
(74) *Attorney, Agent, or Firm* — Barley Snyder

(57) ABSTRACT

A switch element for use in a potentially explosive area is disclosed. The switch element has a base plate, a housing connected to the base plate and forming a cavity between the base plate and the housing, the cavity communicating with an area exterior of the switch element through an opening formed in either the base plate or the housing, and a plurality of contacts for closing and opening an electrical circuit disposed in the cavity.

18 Claims, 3 Drawing Sheets

(58) Field of Classification Search
USPC ..... 200/302.1
See application file for complete search history.

(56) References Cited

U.S. PATENT DOCUMENTS

| | | | | |
|---|---|---|---|---|
| 4,427,863 | A | 1/1984 | Fujita | |
| 5,880,401 | A | 3/1999 | Leischner et al. | |
| 6,095,568 | A | 8/2000 | Fendt et al. | |
| 6,202,435 | B1 | 3/2001 | Fujitaka et al. | |
| 7,321,281 | B2 * | 1/2008 | Molyneux | H01H 50/023 335/202 |
| 9,004,303 | B2 | 4/2015 | Schwarz et al. | |
| 2006/0207437 | A1 * | 9/2006 | Zhang | A47J 37/0842 99/389 |
| 2010/0066471 | A1 | 3/2010 | Nagura et al. | |
| 2010/0193475 | A1 | 8/2010 | Kamiya et al. | |
| 2012/0139672 | A1 | 6/2012 | Takaya et al. | |

FOREIGN PATENT DOCUMENTS

| | | | |
|---|---|---|---|
| DE | 19634673 | C2 | 8/1998 |
| EP | 0986290 | A2 | 3/2000 |
| EP | 2214192 | A2 | 8/2010 |
| GB | 750374 | | 6/1956 |
| GB | 750374 | A | 6/1956 |
| JP | 4712428 | | 5/1972 |
| JP | 5619814 | A | 2/1981 |
| JP | 5866537 | U | 5/1983 |
| JP | 3004854 | U | 9/1994 |
| JP | 11125482 | A | 5/1999 |
| JP | 200773470 | A | 3/2007 |
| JP | 2010177165 | A | 8/2010 |

OTHER PUBLICATIONS

PCT Written Opinion and Search Report, dated Jul. 24, 2015, 15 pages.
Abstract of DE2902169, dated Jul. 31, 1980, 1 page.
Abstract of EP0986290, dated Mar. 15, 2000, 1 page.
Chinese First Office Action and English translation, dated Dec. 12, 2017, 19 pages.
Japanese Notice of Reasons for Refusal, dated Oct. 24, 2017, 9 pages.

* cited by examiner

SWITCH ELEMENT WITH AN OPENING FOR USE IN A POTENTIALLY EXPLOSIVE AREA

CROSS-REFERENCE TO RELATED APPLICATIONS

This application is a continuation of PCT International Application No. PCT/EP2015/059688, filed on May 4, 2015, which claims priority under 35 U.S.C. § 119 to German Patent Application No. 102014006957.5, filed on May 12, 2014.

FIELD OF THE INVENTION

The present invention relates to a switch element, and more particularly, to a switch element connecting an electrical circuit in a potentially explosive area.

BACKGROUND

Known electrical switch elements, such as relays, used in potentially explosive areas are produced such that an explosive gas mixture of the potentially explosive area cannot pass inside the switch element. If the explosive mixture were to pass inside the switch element, it could be ignited by a switching spark or a switching arc that occurs between two contacts of the switch element, and could consequently explode. The energy released by the explosion would destroy the switch element and be released suddenly into the area surrounding the switch element. As a result, the density of energy in the immediate vicinity of the switch element would be very high, and this could lead to damaging ignition of the explosive mixture throughout the explosive area.

The known switch element is hermetically sealed to prevent the explosive mixture from penetrating into the inside. The hermetic sealing may be accomplished, for example, by means of a metal capsule that is welded at the seams. Welding can be used to form the requisite hermetic seal, however, the effort required to form the tight seal using welding is substantial. Further, the welded seam may be damaged by heat, for example, when soldering on relay connections of the electrical switch element. Additionally, relays are electromechanical components which, by their nature, are subject to wear and tear; the contact resistance may increase due to wear and tear of the contacts, and this may lead to an increase in the production of heat, damage of the seal, and ultimately to leaking of the gas mixture into the electrical switch element.

SUMMARY

An object of the invention, among others, is to provide a switch element having an inside which does not need to be hermetically sealed when used in a potentially explosive area. The disclosed switch element has a base plate, a housing connected to the base plate and forming a cavity between the base plate and the housing, the cavity communicating with an area exterior of the switch element through an opening formed in either the base plate or the housing, and a plurality of contacts for closing and opening an electrical circuit disposed in the cavity.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a switch element. This invention may, however, be embodied in many different forms and should not be construed as limited to the embodiments set forth herein; rather, these embodiments are provided so that this disclosure will be thorough and complete and still fully convey the scope of the invention to those skilled in the art.

Figures 1A, 1B:
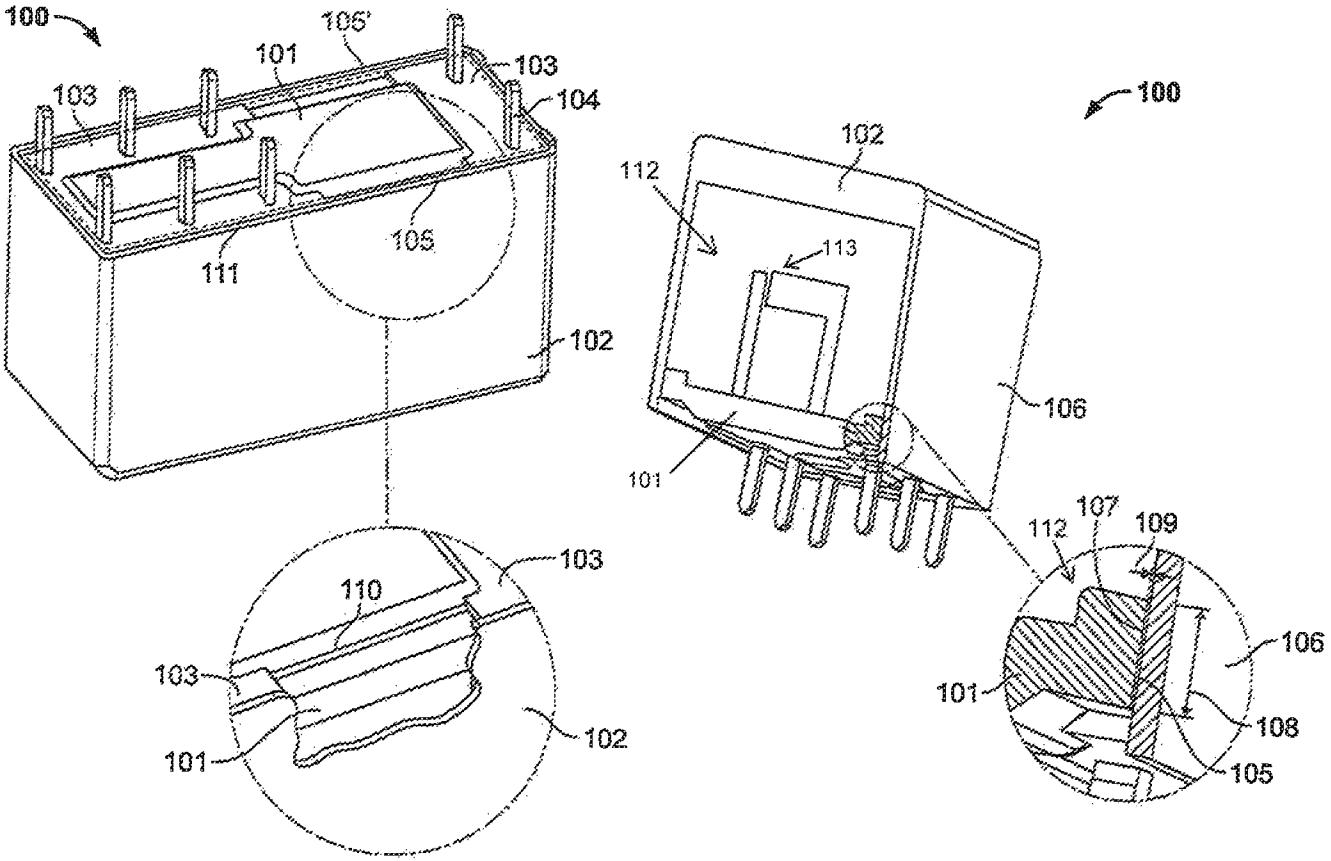
FIG. 1*a* is a bottom perspective and a detailed view of a switch element according to an embodiment of the invention.
FIG. 1*b* is a top perspective and a detailed sectional view of the switch element of FIG. 1*a;*

A switch element 100 according to the invention is shown in FIGS. 1*a* and 1*b*. The switch element 100 has a base plate 101 and a housing 102.

The base plate 101 has a periphery 111. As shown in FIG. 1*a*, a seam extends between the base plate 101 and the housing 102 along the periphery 111. With the exception of two gaps 105 and 105', which are disposed on opposite sides of the base plate 101, the base plate 101 is sealed to the housing 102 along the periphery 111 with a filling compound 103.

The gap 105, as shown in FIGS. 1*a* and 1*b*, extends along the seam between the base plate 101 and the housing 102, and is formed by a side face 107 of the base plate 101 and a side wall 106 of the housing 102. Here the side face 107 of the base plate 101 is fully covered by the side wall 106 of the housing 102. The gap 105' is formed similarly to the gap 105. No filling compound 103 is provided at the locations of the base plate 101 where the gaps 105 and 105' are disposed. As shown in FIG. 1*a*, the gap 105 has a length 110 extending along the periphery 111. The gap 105, as shown in FIG. 1*b*, also has a width 109 and a height 108. In the shown embodiment, the width 109 is less than 0.1 mm and the height 108 is greater than 1 mm. The gap 105' similarly has a width 109' which is smaller than 0.1 mm and a height 108' which is greater than 1 mm. Furthermore, the sum of the lengths 110, 110' of the gaps 105, 105' is less than one third of the length of the periphery 111.

As shown in FIGS. 1*a* and 1*b*, the housing 102 is connected to the base plate 101 to form a rectangular parallelepiped. A cavity 112 is formed between the base plate 101 and the housing 102. A plurality of contacts 113 for closing or opening an electrical circuit are provided in the cavity 112. Voltage can be applied to these contacts 113 by a plurality of connecting terminals 104 extending through the base plate 101. Due to this voltage, a switching spark or a switching arc may occur upon opening or closing the contacts 113, potentially igniting an explosive mixture within the cavity 112.

The cavity 112 communicates with an area exterior of the switch element 100 through the opening formed by the gaps 105, 105'. The two gaps 105 and 105' thus constitute an opening of the switch element 100 to the outside via which the explosive energy, which is released during an explosion within the switch element 100, can escape to the outside. The two gaps 105 and 105' are dimensioned to release the escaping explosive energy over a sufficiently long period of time such that the explosive energy escaping to the outside is not capable of igniting the explosive mixture exterior of the switch element 100. The escaping explosive energy does not increase the density of energy in the immediate exterior of the switch element 100 such that an exterior explosion is avoided.

The switch element 100 has two gaps 105, 105' in the embodiment shown in FIGS. 1*a* and 1*b*. In other embodiments, the switch element 100 may have only one gap 105 or more than two gaps 105. If the switch element 100 has only one gap 105, the length 110 of the gap 105 is less than one third of the length of the periphery 111. If the switch element 100 has more than two gaps 105, the summed lengths 110 of the gaps 105 is less than one third of the length of the periphery 111.

Figure 2:
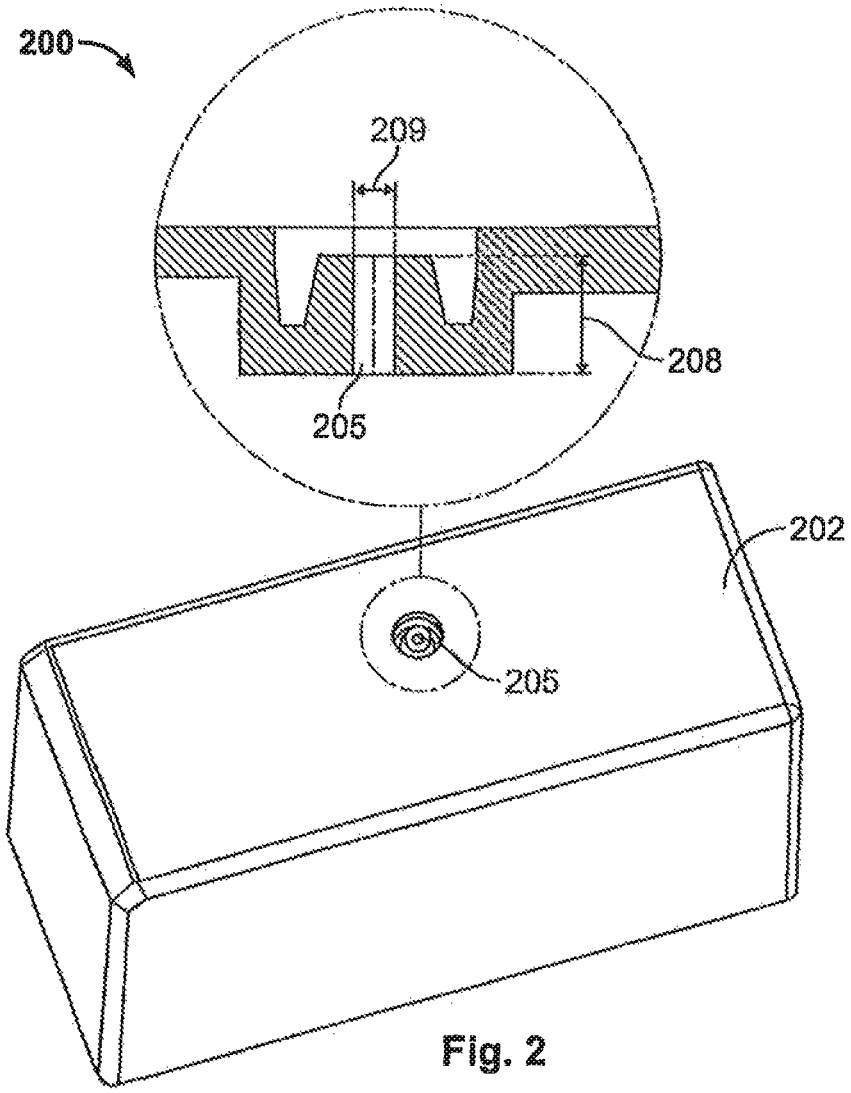
FIG. 2 is a perspective and detailed sectional view of a switch element according to another embodiment of the invention.

In the switch element 100, as shown in FIG. 1*b*, the side wall 106 completely covers the side face 107. In an embodiment, the side wall 106 may only partially cover the side face 107, and at the gap or gaps 105, the base plate 101 has a thickness greater than 1 mm. In another embodiment, a lower edge of the housing 102 abuts an upper surface of the base plate 101 and the seam between the base plate 101 and the housing 102 is formed between the lower edge of the housing 102 and the upper surface of the base plate 101. Switch elements according to other embodiments of the invention will now be described with reference to FIGS. 2 and 3. Only differences with respect to the switch element 100 shown in FIG. 1 will be described in detail. A switch element 200 according to another embodiment of the invention is shown in FIG. 2. The switch element 200 has a passageway 205 formed in the housing 202. The switch element 200 is otherwise completely sealed to the outside; a seam between a base plate and the housing 202 is sealed with a filling compound. The passageway 205 is cylindrical with a diameter 209 and a height 208. In the shown embodiment, the diameter 209 is less than 0.4 mm and the height 208 is greater than 1.2 mm.

As in the switch element 100, the cavity of the switch element 200 communicates with an area exterior of the switch element 200 through an opening in the switch element 200 formed by the passageway 205. The passageway 205 is thus an opening of the switch element 200 to the outside via which explosive energy released during an explosion within the switch element 200 can escape via to the outside. The passageway 205 is dimensioned to release the explosive energy escaping over a sufficiently long period of time such that the explosive energy escaping to the outside is not capable of igniting the explosive mixture exterior of the switch element 200.

In the shown embodiment, the passageway 205 is disposed in the middle of the housing 202, however, the passageway 205 could be disposed on any part of the housing 202 or on any part of the base plate. The passageway 205 is also shown as cylindrical, but could have any cross-section, for example, oval, rectangular or square. The cross-sectional area of the passageway 205 is less than 0.1256 $mm^2$ at its narrowest point and the passageway 205 has a height greater than 1.2 mm. The passageway 205 may alternatively be conical, or may have a biconical or meandering form in the longitudinal direction. The passageway 205 tapers in a middle or at its ends if the passageway 205 has a biconical form.

Figure 3:
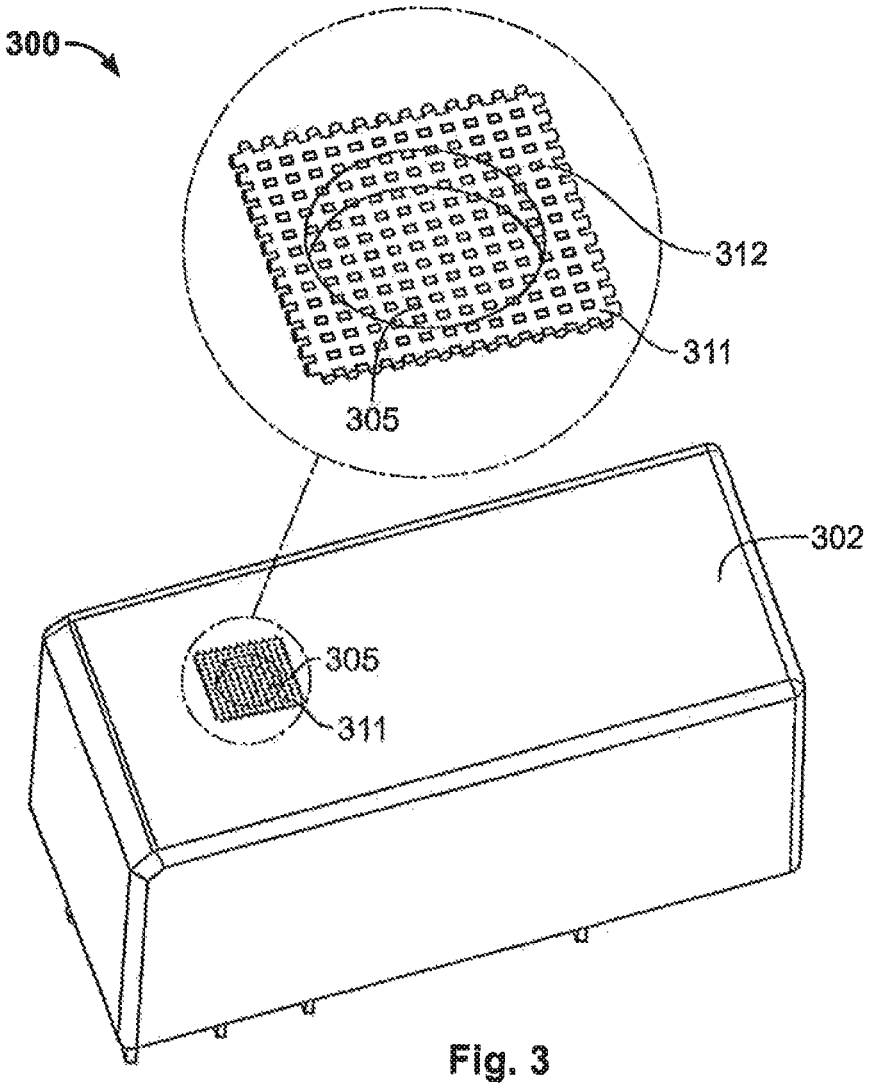
FIG. 3 is a perspective and detailed view of a switch element according to another embodiment of the invention.

A switch element 300 according to another embodiment of the invention is shown in FIG. 3. The switch element 300 has a passageway 305 formed in the housing 302. The passageway 305 is covered from the outside with a grid 311. The grid 311 may be metal and has a mesh 312 size of less than 0.1 mm. The grid 311 has rectangular or square meshes 312 which have an area less than 0.01 $mm^2$. The passageway 305 could have a variety of shapes, heights, depths, and cross-sections, and could be disposed on any part of the housing 302 or on any part of the base plate. The switch element 300 is otherwise completely sealed to the outside; a seam between a base plate and the housing 302 is sealed with a filling compound.

As in the switch element 100, the cavity of the switch element 300 communicates with an area exterior of the switch element 300 through an opening in the switch element 300 formed by the passageway 305 covered by the grid 311. The passageway 305 covered by the grid 311 is thus an opening of the switch element 300 to the outside via which explosive energy released during an explosion within the switch element 300 can escape via to the outside. The grid 311 has a mesh 312 dimensioned to release the explosive energy escaping over a sufficiently long period of time. Further, the grid 311 absorbs part of the explosive energy. The explosive energy escaping to the outside is consequently not capable of igniting the explosive mixture exterior of the switch element 300.

The grid 311 may alternatively be formed from a plastic having a metal coating or containing metal or a ceramic coated with metal or containing metal. The mesh 312 may alternatively have circular, oval, or diamond-shaped openings. In all embodiments, the area of the mesh 312 is smaller than 0.01 $mm^2$.

Switch elements 100, 200, and 300 according to the present invention are relays used, for example, for connecting main voltages (230 V for single-phase or 400 V for three-phase alternating voltages) in potentially explosive areas.

Advantageously, in the switch elements 100, 200, and 300 according to the invention, any escaping explosive energy that is released during an explosion within the switch element 100, 200, 300 is released over a sufficiently long period of time such that the explosive energy escaping to the outside does not ignite an area exterior of the switch element 100, 200, 300, avoiding the need to form a difficult and unreliable hermetic seal on the switch element 100, 200, 300.

What is claimed is:

1. A switch element comprising:

a base plate;

a housing connected to the base plate and forming a cavity between the base plate and the housing, the cavity communicating with an area exterior of the switch element through an opening formed only in the base plate, only in the housing, or between only the base plate and the housing, the cavity is otherwise sealed from the area exterior of the switch element aside from the opening, the opening is dimensioned to release any escaping explosive energy from an explosion in the cavity over a period of time such that the explosive energy escaping to the outside is not capable of igniting an explosive mixture exterior of the switch element; and a plurality of contacts for closing and opening an electrical circuit disposed in the cavity.

2. The switch element of claim 1, wherein the switch element is a relay.

3. The switch element of claim 1, wherein the opening is a passageway, and a cross-sectional area at a narrowest point of the passageway is less than 0.1256 $mm^2$.

4. The switch element of claim 3, wherein the passageway has a height greater than 1.2 mm.

5. The switch element of claim 4, wherein the passageway has a circular or oval cross-section.

6. The switch element of claim 4, wherein the passageway has a square or rectangular cross-section.

7. The switch element of claim 4, wherein the passageway is cylindrical, conical, or biconical.

8. The switch element of claim 1, wherein the opening is a passageway covered with a grid.

9. The switch element of claim 8, wherein the grid has a mesh with an area less than 0.01 $mm^2$.

10. The switch element of claim 9, wherein the mesh is square.

11. The switch element of claim 9, wherein the grid is formed from a metal, a plastic coated in metal or containing metal, or a ceramic coated in metal or containing metal.

12. The switch element of claim 1, wherein the opening is a gap formed between the base plate and the housing.

13. The switch element of claim 12, wherein the gap is formed only between a side face of the base plate and the housing.

14. The switch element of claim 13, wherein the base plate and the housing form a rectangular parallelepiped and the side face of the base plate is fully covered by the housing.

15. The switch element of claim 13, wherein the gap has a length less than one third of a length of a periphery of the base plate.

16. The switch element of claim 15, wherein the gap has a width less than 0.1 mm and a height greater than 1 mm.

17. The switch element of claim 15, wherein a filling compound seals the side face of the base plate and the housing along the periphery of the base plate except for the gap.

18. The switch element of claim 1, wherein the opening is a plurality of gaps formed between the base plate and the housing, a sum of lengths of the plurality of gaps is less than one third of a length of a periphery of the base plate.

* * * * *